US008267148B1

(12) United States Patent
Megel et al.

(10) Patent No.: US 8,267,148 B1
(45) Date of Patent: Sep. 18, 2012

(54) HYBRID CERAMIC/SAND CORE FOR CASTING METAL PARTS HAVING SMALL PASSAGES

(75) Inventors: Marc C. Megel, LaVernia, TX (US); Douglas A. McKee, Helotes, TX (US); Barry E. Westmoreland, Adkins, TX (US); Keith E. Denholm, Shrewsbury (GB)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 13/229,352

(22) Filed: Sep. 9, 2011

(51) Int. Cl.
*B22C 9/10* (2006.01)

(52) U.S. Cl. ..... 164/28; 164/19; 164/200; 164/369

(58) Field of Classification Search ..... 164/19–22, 164/28, 369, 200–202
See application file for complete search history.

(56) References Cited

U.S. PATENT DOCUMENTS

2003/0075301 A1* 4/2003 Kimbrough et al. ..... 164/369
2009/0160092 A1* 6/2009 Jahnz ..... 264/299

* cited by examiner

*Primary Examiner* — Kuang Lin
(74) *Attorney, Agent, or Firm* — Chowdhury & Georgakis, P.C.; Ann C. Livingston

(57) ABSTRACT

A hybrid ceramic/sand casting method of manufacturing a metal part. The method is especially suitable for parts having one or more very small internal gaps, such as might occur with a linear passage or round opening. These parts are formed using a hybrid core having at least one ceramic section and at least one sand section, with the ceramic section being used to create the internal gap. A mold cavity is created for the part, and the hybrid core is positioned in the mold. Molten metal is introduced into the mold, and after the metal cools, the core is removed, thereby forming the part with the internal gap.

5 Claims, 3 Drawing Sheets

HYBRID CERAMIC/SAND CORE FOR CASTING METAL PARTS HAVING SMALL PASSAGES

TECHNICAL FIELD OF THE INVENTION

This invention relates to sand casting for the manufacture of metal parts, and more particularly to methods of using a hybrid ceramic and sand core for making parts having small passages.

BACKGROUND OF THE INVENTION

Sand casting, also known as sand molded casting, is a process for casting parts, normally metal parts, characterized by using sand as the mold material. A suitable bonding agent is mixed with the sand to develop coherency for molding and strength and stiffness of the cured mold.

For manufacturing metal objects, the basic steps of the sand casting process are quite simple. A pattern is made for the object to be produced, typically using wood, metal, or a plastic. The pattern is placed in a suitable sand mixture, contained and cured in a casting box, to create a sand mold. The pattern is removed, to form the mold cavity, and the mold cavity is filled with molten metal. After the metal cools, the sand mold is broken away leaving the desired casting.

To produce internal holes and passages within the casting, "cores" are used. A core is formed independently of the sand mold, usually also from sand, then positioned in the mold cavity, with some means for supporting the core in position. The positioning means may be one or more recesses in the pattern called "core prints" or small supporting pieces between the core and cavity surface called "chaplets". Then, the molten metal is introduced as described above.

A limitation of sand casting is the achievable cross section size of internal passages. This is because as sand core cross section dimensions are reduced, the core's ability to resist premature breakdown in the presence of molten metal is also reduced. Thus, there are limiting dimensions below which a sand core will disintegrate during casting by effects that include thermal shock, evaporation of binder and penetration of the sand core.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to sand casting methods of manufacturing parts, using hybrid ceramic and sand cores. It is assumed that the part to be manufactured has at least one internal passage. As explained in the Background, in conventional sand casting, for such parts, the pattern uses sand cores.

One embodiment of the invention is a hybrid core for a metal part having internal passages. The core has both sand and ceramic sections joined together to form a single structure. The ceramic section is used in the region that forms small passages. The ceramic section allows much smaller passages to be formed than those achievable using a traditional core made entirely of sand.

For purposes of example, the methods are described in terms of manufacturing cylinder heads for internal combustion engines. Conventionally, cylinder heads are manufactured using sand casting. This is due to the need for geometrically complex internal fluid passages as well as for low production cost. The intricate shape capability of sand cores, the ability to easily extract them from finished castings, and the low material cost make sand casting well suited to the functional and economic requirements of making engine cylinder heads.

However, certain engine cylinder head geometries have been developed that use internal passages too small to reliably manufacture with conventional sand casting. Examples of such cylinder head geometries are described in U.S. patent application Ser. Nos. 12/578,910 and 12/578,936. These cylinder heads may have thick structural metal sections, cooled by a fluid coolant media in internal passages that are too small to cast by standard sand core methods.

Figure 1:
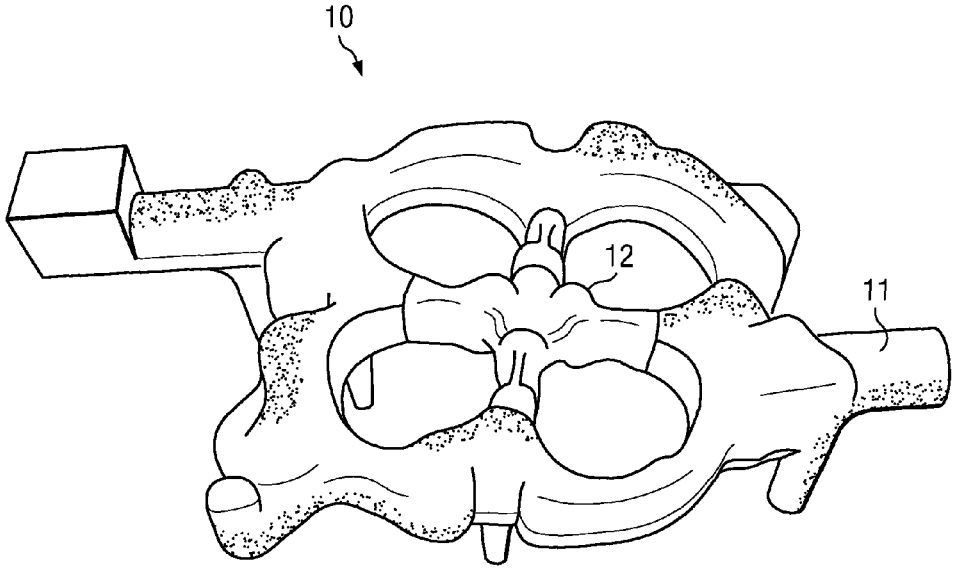
FIG. 1 illustrates a hybrid core for use during a sand casting process.

FIG. 1 illustrates a hybrid casting core 10 in accordance with the invention. In the example of this description, the casting core 10 is used for making internal combustion engine coolant jackets. Specifically, core 10 is used to form a lower water jacket of a two-piece water jacket for a cylinder head. However, as explained below the same method may be applied for making any part having one or more small internal gaps, such as might occur with a linear passage, annulus, or opening.

The core 10 has both a sand section 11 and a ceramic section 12, which are joined together to form a single structure. Various means may be used for attaching the sand section 11 to the ceramic section 12, with one example given below.

In the example of this description, the ceramic section 12 is used in the region that forms coolant passages between the engine's gas exchange port walls and injector/igniter boss. More specifically, the ceramic section 12 is used to form valve bridge passages as well as the annulus around each cast injector sleeve. The use of ceramic for this part of the core allows much smaller passages to be formed than those achievable using a traditional core made entirely of sand. This enables key design features of a high pressure cylinder head, such as thick port walls and an integral injector/igniter boss, to be cast with passages for adequate coolant exposure.

The ceramic section 12 of core 10 may be manufactured by various means, with one example being an injection molding process. Because only a small portion of the casting core pack is made of ceramic, the economic impact is acceptable, both from a raw materials standpoint and level of effort required for core extraction after casting. Although conventional methods for removing sand cores may not be suitable, alternative methods are known and used in foundries today. For example, to remove the ceramic section 12, a caustic solution cleaning process may be used to leach the core out of the finished casting.

Figure 2:
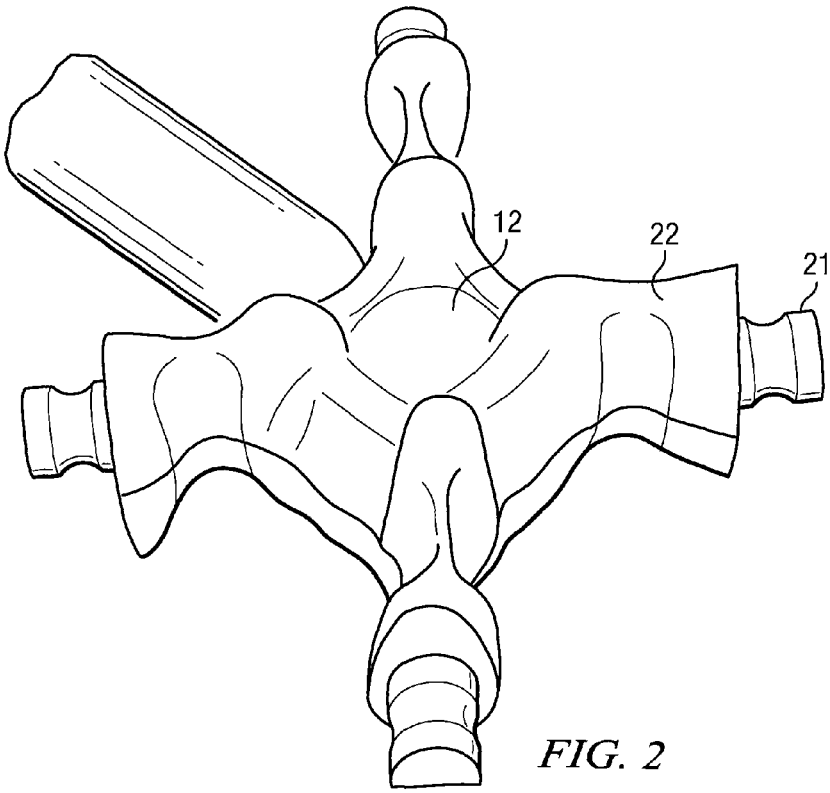
FIG. 2 illustrates the ceramic section of the hybrid core of FIG. 1.

FIG. 2 illustrates one method of attachment between the ceramic section 12 and sand section 11. Other methods can be used, but in the example of FIG. 2, a mechanically captive interface is formed by blowing sand around small lugs protruding from the ceramic section 12. Upon curing of the binder resin in the sand, the ceramic is captured by the sand.

In FIG. 2, the ceramic section 12 of FIG. 1 is shown before attachment to the sand core section 11. The ceramic section 12 has four "spars" that will form passages. An attachment lug 21 is part of the ceramic section 12 on the end of each of the four spars 22. The lugs may be formed during the molding of the ceramic section as an integral part of the ceramic section.

The lug attachment means of FIG. 2 is especially suitable for a ceramic section having a "hub" and "spar" configuration, in which a lug can be formed at the far end of each spar.

Except for the attachment of the ceramic section 12, the sand section 11 of core 10 may be made by conventional means. It may be made by mixing sand with a binder in a wooden or metal core box, which contains a cavity in the shape of the desired core.

Figure 3:
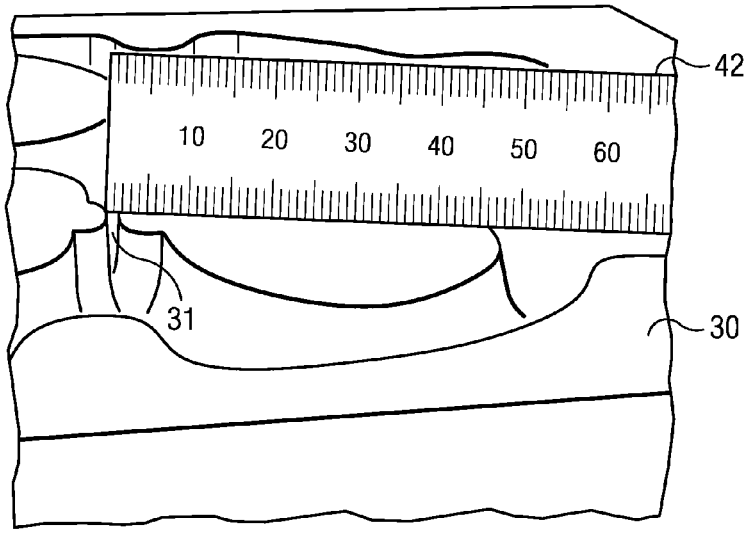
FIG. 3 illustrates a portion of a metal casting made from the hybrid core of FIG. 1.

FIG. 3 illustrates a portion of a cast metal part 30 formed from the core 10 of FIG. 1. For the example of this description (an engine water jacket), the part is made from iron, including various iron-based alloys. Typical of sand casting methods, upon sufficient cooling of the metal, the core 10 has been removed to reveal the intended solid and void sections of the cast part.

The ceramic section 12 of core 10 corresponds to the very narrow gap of passage 41. As shown by the ruler 42, this gap 41 illustrates the capability to successfully and reliably achieve very narrow passages without flashing, as small as on the order of 1.5 mm wide, irrespective of section height. A conventional sand core would not be able to reliably produce a gap any smaller than 5 mm width in the same part assuming sufficient height for adequate heat transfer and structural integrity. It is expected that the hybrid core can be of practical use for gaps of less than 10 mm width.

In practice, for a particular part to be cast, the size of gaps and passage diameters will be measured. It is expected that a hybrid core will be used in a part having an internal gap of less than 5 mm. For purposes of this description, by "internal" gap is meant a gap that occurs by being made with a core inside the mold cavity. The term "gap" includes the cross section or diameter of any linear or circular passage. The hybrid core will have one or more ceramic sections for making those passages.

A feature of the hybrid core casting method described herein is that only a very small portion of the overall core of a part (such as a cylinder head) is made from ceramic. Therefore, most of the core can be removed by traditional mechanical extraction techniques.

Figure 4:
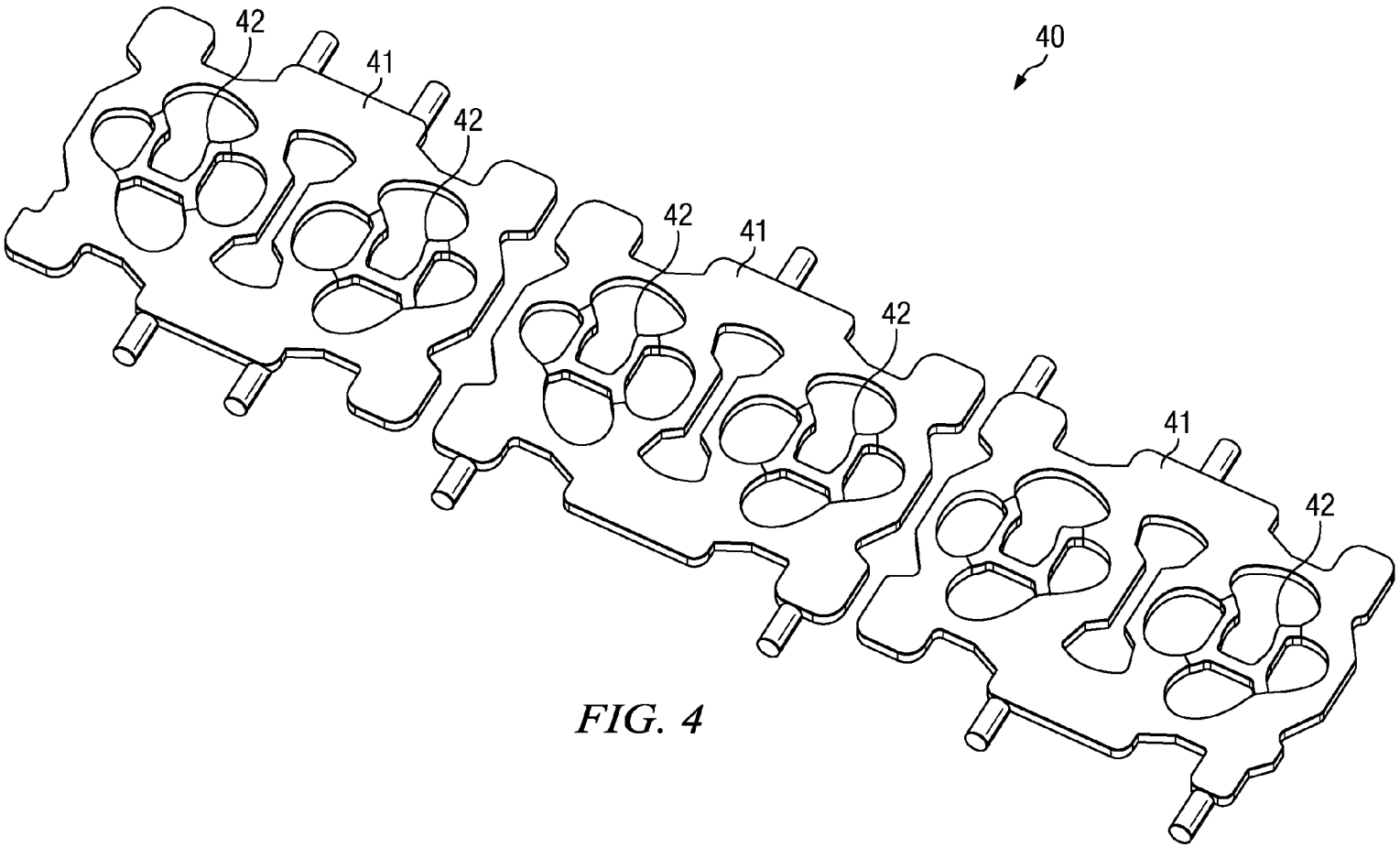
FIG. 4 illustrates a hybrid core for an engine water jacket, having ceramic sections to form valve bridge passages.

FIG. 4 illustrates a complete hybrid core 40 for a lower water jacket of a six-cylinder engine cylinder head. This cylinder head design has a two-piece (upper and lower) water jacket with a full cast injector sleeve. Core 40 has both a sand section 11 and ceramic sections 12. The hybrid sections 42 have a slightly different configuration than that of FIG. 1, but like FIG. 1, they permit very small passages to be formed.

Figure 5:
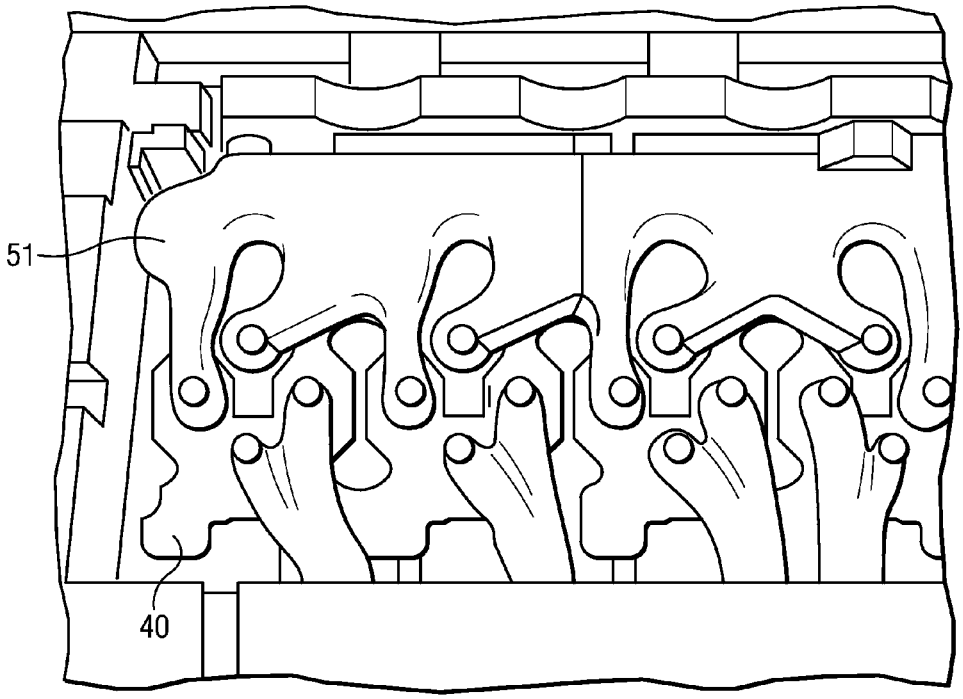
FIG. 5 illustrates the core of FIG. 4 with a intake/exhaust port core also installed.

FIG. 5 illustrates the lower water jacket core 40 of FIG. 4, with an intake/exhaust port core 51 also installed. These cores represent the inverse of the metal casting to be manufactured.

In addition to extra material expense, full ceramic cores also cost significantly more to extract from the finished cast part, often requiring chemical dissolution of the entire casting. Although full ceramic core castings are currently used in certain aerospace applications, for these applications, the extra expense of full ceramic cores can be justified based on safety requirements.

What is claimed is:

1. A hybrid ceramic/sand casting method of manufacturing a part, comprising:

determining whether the part has at least one internal gap of less than ten millimeters, and if so, providing a hybrid core having at least one ceramic section and at least one sand section;

wherein the ceramic section is used to create the internal gap;

creating a mold cavity for the part;

positioning the hybrid core in the mold;

introducing molten metal into the mold;

removing the core, after the metal cools, thereby forming the part with the internal gap.

2. The method of claim 1, wherein the ceramic core is made independently from the sand core, and the sand core then attached to the ceramic core.

3. The method of claim 1, wherein the ceramic core has at least one lug, and the sand core is attached to the lug by being formed around the lug.

4. The method of claim 1, wherein the ceramic core is manufactured by means of injection molding.

5. The method of claim 1, wherein the removing step is at least in part performed by a chemical dissolution process to remove the ceramic section.

* * * * *